US007021907B2

(12) United States Patent
Hobmeyr et al.

(10) Patent No.: US 7,021,907 B2
(45) Date of Patent: Apr. 4, 2006

(54) VENTILATION AND PURGE OF A HYDROGEN BLOWER

(75) Inventors: Ralph Hobmeyr, Mainz-Kastel (DE); Bernhard Wnendt, Rüsselsheim (DE); Roland Matthé, Bischofsheim (DE)

(73) Assignee: General Motors Corporation, Detroit, MI (US)

( * ) Notice: Subject to any disclaimer, the term of this patent is extended or adjusted under 35 U.S.C. 154(b) by 368 days.

(21) Appl. No.: 10/407,096

(22) Filed: Apr. 3, 2003

(65) Prior Publication Data

US 2004/0197205 A1 Oct. 7, 2004

(51) Int. Cl.
*F04B 17/03* (2006.01)
*F01D 11/00* (2006.01)

(52) U.S. Cl. ..... 417/368; 417/423.8; 417/423.11; 415/168.2

(58) Field of Classification Search ..... 417/366, 417/368, 423.8, 423.11; 415/168.2, 168.3, 415/168.4
See application file for complete search history.

(56) References Cited

U.S. PATENT DOCUMENTS 3,532,444 A * 10/1970 Strub ..... 417/423.11
4,527,960 A * 7/1985 DeSisto ..... 417/368
4,764,086 A * 8/1988 Jesinger ..... 415/112
6,203,294 B1 * 3/2001 Turley et al. ..... 417/423.11
2003/0053907 A1 3/2003 Lippert et al. ..... 415/112

FOREIGN PATENT DOCUMENTS

| | | |
|---|---|---|
| DE | 1097614 | 1/1961 |
| DE | 1293390 | 4/1969 |
| JP | 2002246058 | 8/2002 |

OTHER PUBLICATIONS

Drawing of prior art blower design, date unknown.

* cited by examiner

*Primary Examiner*—Charles G. Freay
(74) *Attorney, Agent, or Firm*—Harness, Dickey & Pierce, P.L.C.

(57) ABSTRACT

A hydrogen blower is provided and includes a housing having a drive unit and a compressor unit disposed therein. The drive unit is separated from the compressor unit by a neutral chamber, whereby the neutral chamber effectively seals the drive unit from the compressor unit. The drive unit includes a drive shaft, whereby the drive shaft extends generally between the drive unit and the compressor unit to selectively drive the compressor. In addition, the drive shaft fixedly supports a series of fan blades such that rotation of the drive shaft imparts a pressure on the neutral chamber to effectively seal the drive unit from the compressor unit. In this manner, the drive motor, compressor, and drive shaft may be packaged in a single housing while effectively sealing the drive unit from the compressor unit through cooperation between the fan blades and the neutral chamber.

23 Claims, 3 Drawing Sheets

VENTILATION AND PURGE OF A HYDROGEN BLOWER

FIELD OF THE INVENTION

The present invention relates to hydrogen blowers, and more particularly, to an improved hydrogen blower for use in a fuel cell system.

BACKGROUND OF THE INVENTION

In hydrogen blower applications, it is desirable to package a drive unit and a compressor unit within a single housing. Further, it is desirable that the drive unit be capable of selectively driving the compressor unit in response to system load. Further yet, it is desirable that the drive unit and compressor unit are disposed in separate chambers within the housing to effectively seal the drive unit from the compressor unit. To that end, a sealing system disposed between the drive unit chamber and the compressor unit chamber plays a significant role.

Typically, a hydrogen blower is used within a fuel cell system or in a hydrogen storage application such as at a hydrogen station or the like to supply a stream of compressed hydrogen to a fuel cell stack. In a typical fuel cell system, a hydrocarbon fuel is processed in a fuel processor, for example, by reformation and partial oxidation processes, to produce a reformate gas which has a relatively high hydrogen content on a volume or molar basis. This hydrogen gas is fed through an anode chamber of a fuel cell stack. At the same time, oxygen in the form of an air stream is fed into a cathode chamber of the fuel cell stack. The hydrogen from the reformate stream and the oxygen react in the fuel cell stack to produce electricity. To maintain a constant and consistent stream of hydrogen supply to the fuel cell stack, a hydrogen blower is typically provided between the reformation process and the fuel cell stack.

Conventional hydrogen blower systems, compress and store hydrogen within a housing due to the interaction of a drive unit and a compressor unit. Specifically, a conventional drive unit such as an electric motor is disposed within the housing and includes a drive shaft fixedly attached to the compressor unit to selectively drive the compressor unit in response to a system load. Typically, the compressor unit includes a series of impellers, whereby the impellers compress the hydrogen due to the rotation of the drive shaft and the interaction of the air flow therein. In this manner, the compressed hydrogen is typically stored within the housing and may be selectively released when needed. Releasing of the compressed hydrogen governs the system load as more hydrogen will need to be compressed as the housing is drained, thus regulating the rate and frequency at which the drive unit rotates the impellers.

To ensure that the hydrogen blower maintains a high efficiency, a seal is commonly disposed between the drive unit and the compressor unit. The seal serves to keep the compressed hydrogen separate from the drive unit in an effort to maintain the efficiency of the compressor. As can be appreciated, any loss of hydrogen between the compression unit and the drive unit results in an overall loss in blower efficiency. Conventional sealing systems commonly include a flexible member or ring such as a rubber gasket, or the like, disposed between the drive unit and the compressor unit. The gasket is commonly fixedly attached to the drive shaft for rotation therewith and forms a barrier between the drive and compression units.

While adequately preventing the hydrogen from passing from the compression unit to the drive unit, the conventional sealing systems can be complex, expensive to manufacture, and create a relatively large amount of frictional resistance.

Therefore a hydrogen blower that provides a drive unit operable to drive a compressor unit disposed within a common housing, while maintaining a seal between the drive unit and the compressor unit, is desirable in the industry. Additionally, providing a seal between the drive unit and a compressor unit that improves and maintains high efficiency is also desirable.

SUMMARY OF THE INVENTION

Accordingly, the present invention provides a hydrogen blower including a housing having a drive unit and a compressor unit disposed therein. The drive unit is separated from the compressor unit by a neutral chamber, whereby the neutral chamber effectively seals the drive unit from the compressor unit. The drive unit includes a drive shaft, whereby the drive shaft extends generally between the drive unit and the compressor unit to selectively drive the compressor. In addition, the drive shaft fixedly supports a series of fan blades such that rotation of the drive shaft imparts a pressure on the neutral chamber to effectively seal the drive unit from the compressor unit. In this manner, the drive motor, compressor, and drive shaft may be packaged in a single housing while effectively sealing the drive unit from the compressor unit through cooperation between the fan blades and the neutral chamber.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
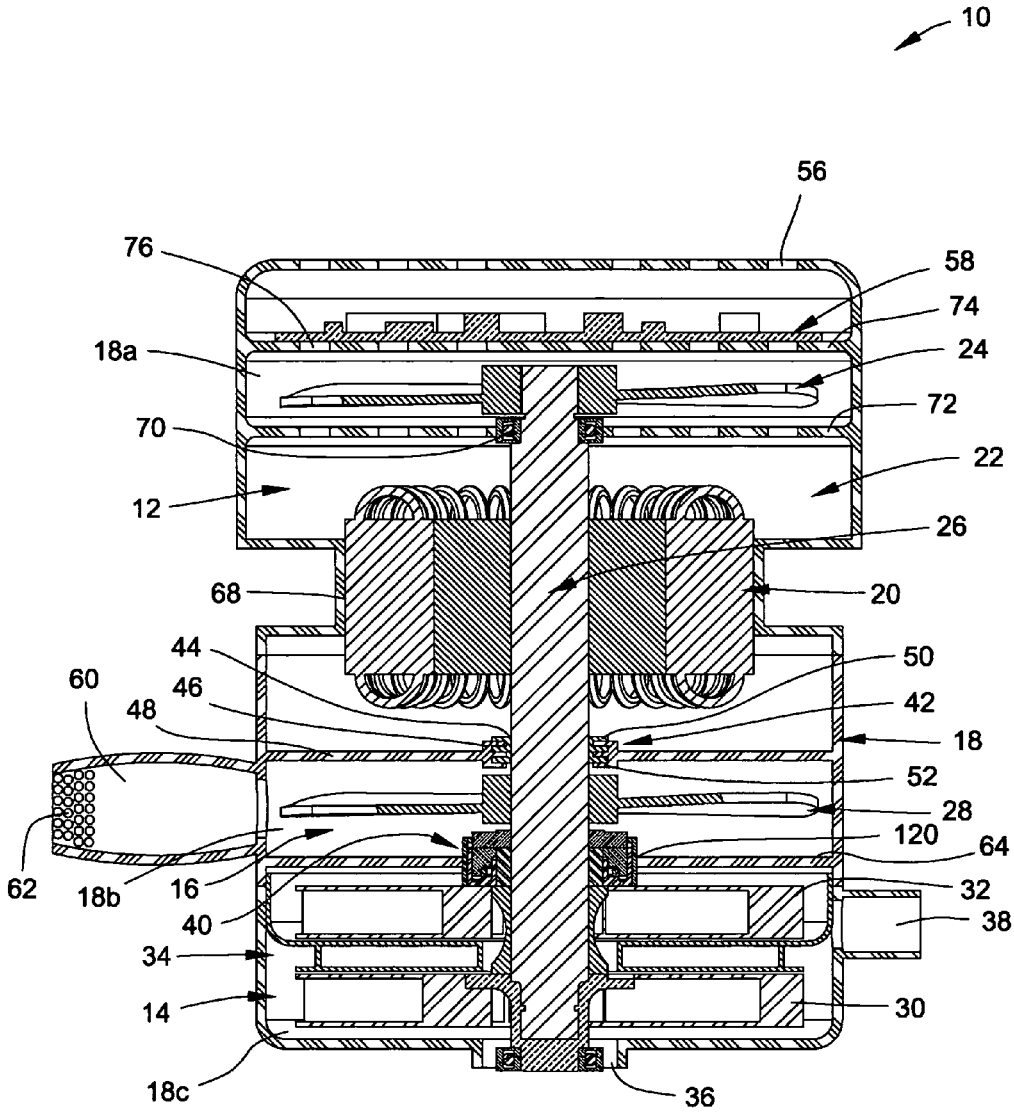
FIG. 1 is a cross-sectional view of a hydrogen blower in accordance with the principles of the present invention.

With reference to FIG. 1, a hydrogen blower 10 is provided and includes a drive unit 12, a compressor unit 14, and a neutral chamber 16, each disposed within a common housing 18. The drive unit 12 includes a motor 20 disposed in a motor chamber 22 of the housing 18. A first fan 24 is connected to a first end of a motor driven shaft 26. A second fan 28 is drivingly connected to the motor shaft 26 and is disposed in the neutral chamber 16. The neutral chamber 16 is disposed between the drive unit 12 and a compressor unit 14 to seal or isolate the compressor unit 14 from the drive unit 16.

The compressor 14 is disclosed as a two-stage impeller-type compressor including a first impeller 30 and a second impeller 32 which are each disposed in a compressor chamber 34 of the housing 18 and are rotatably driven by the shaft 26 connected to the motor 20. The compressor chamber 34 includes an inlet passage 36 and an outlet passage 38. The inlet passage 36 is concentrically disposed about the end of the shaft 26 while the outlet passage 38 is provided in a side surface of the housing 18. According to a preferred embodiment of the present invention, hydrogen gas is drawn into the compressor chamber 34 through the inlet passage 36 and is initially compressed by the first impeller section 30 of the dual stage compressor unit and is then compressed further by the second impeller 32 prior to exiting the compressor chamber 34 through outlet passage 38.

According to one aspect of the present invention, a first bearing and seal assembly 40 is disposed between the compressor chamber 34 and neutral chamber 16. The bearing and seal assembly 40 is designed to inhibit or limit the flow of the compressed hydrogen from the compressor chamber 34 into the neutral chamber 16.

A second seal assembly 42 is provided between the motor chamber 22 and the neutral chamber 16. As best shown in FIG. 1, the seal 42 includes a first cylindrical member 44 which is mounted to the shaft 26 for rotation therewith. A second cylindrical member 46 is supported by a partition plate 48. The first cylindrical member includes radially outwardly extending fins 50 which cooperate with radially inwardly extending fins 52 of the second cylindrical member 46 to form a labyrinth flowpath between the first and second cylindrical members 44, 46.

The housing 18 includes air passages 56 provided in an upper surface of the motor chamber 22. Air is drawn through air passage 56 into the motor chamber 22 by the fan 24. The air entering the motor chamber 22 passes over the controller 32, in the form of a circuit board, to provide cooling for the controller 32. The air then passes through the motor chamber 22 for cooling the motor 20. The fan 24 pressurizes the motor chamber 22 such that a pressure is applied on the motor chamber side of the seal 42 in order to inhibit the flow of gases from the neutral chamber 16 into the motor chamber 22.

While the bearing seal assembly 40 is designed to preferably completely inhibit the flow of hydrogen from the compressor chamber 34 into the neutral chamber 16, any hydrogen that may escape from the compressor chamber 34 through the seal 40 into the neutral chamber 16 will be mixed with air that passes through the second seal 42 into the neutral chamber 16 and is exhausted through exhaust passage 60 provided in the side of the neutral chamber 16 due to the rotation of the fan 28 within the neutral chamber 16. A catalyzer 62 is provided in the outlet passage 60 of the neutral chamber 16, to react the fluid mixture disposed within the neutral chamber prior to the fluid mixture being dissipated from the housing 18.

The housing 18 is preferably comprised of three or more sections, including an upper section 18*a* which primarily encloses the motor chamber 22, an intermediate section 18*b* which primarily encloses the neutral chamber 16, and a lower section 18*c* which primarily encloses the compressor chamber 34. The intermediate housing section 18*b* includes a pair of radially inwardly extending partition plates 64, 48 which support portions of the first and second seal assemblies 40, 42, respectively. The housing 18 includes a recessed portion 68 disposed around the motor 20 for providing support thereof. The motor 20 is a standard motor design that allows air passage through the motor coils to enhance cooling thereof. The upper end of the shaft 26 is supported by a bearing 70 which is supported by a bearing support plate 72 provided with openings therein to allow air passage therethrough. The controller unit 58 is supported by a second support plate 74 provided with openings 76 provided therein to allow cooling air to flow therethrough.

Figure 2:
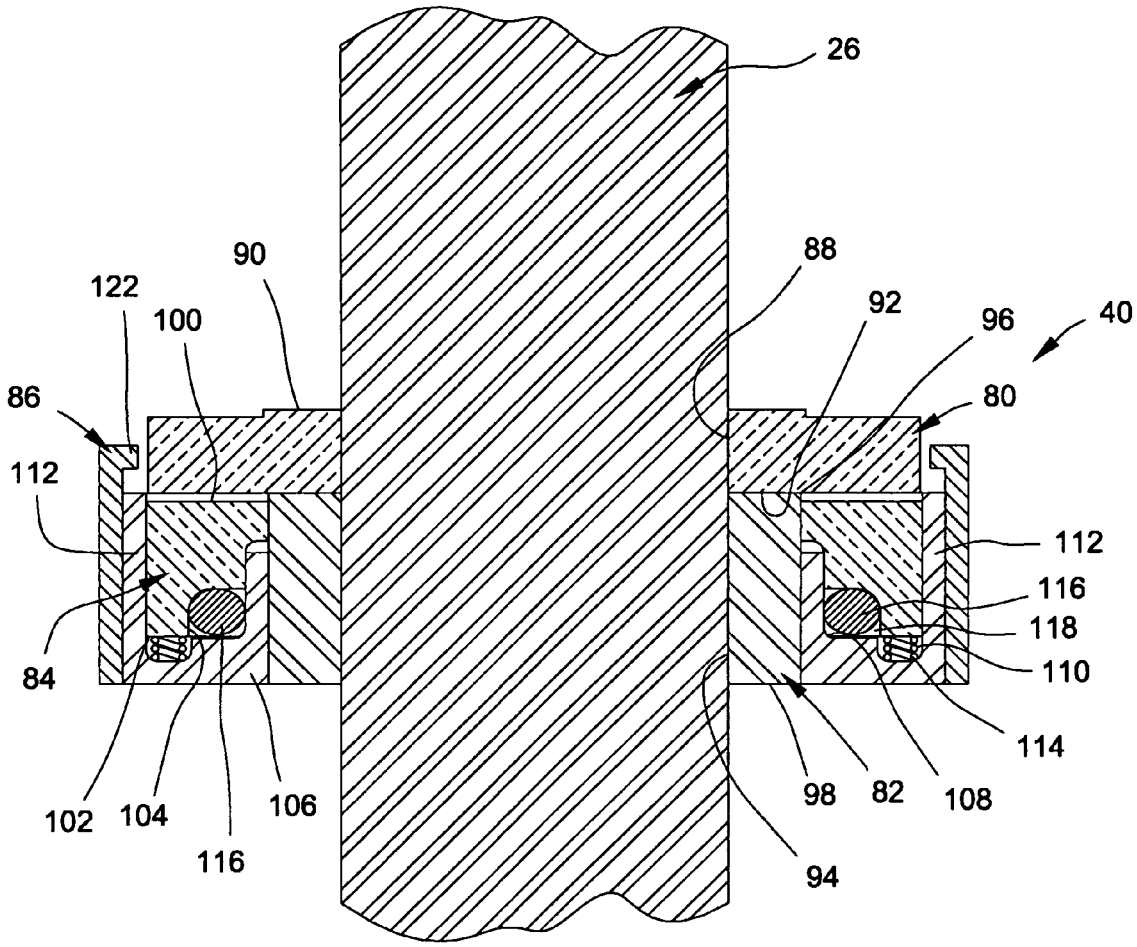
FIG. 2 is a cross-sectional view of a seal of the hydrogen blower shown in FIG. 1.

Now with reference to FIG. 2, the seal 40 disposed between the neutral chamber 16 and compressor chamber 34 will now be described. The seal 40 includes a slide ring 80, a collar 82, a slide head 84, and a shield 86. The slide ring 80 includes a central bore 88 and a first and second surface 90, 92. The central bore 88 fixedly receives the main body of the drive shaft 26 and is fixed for rotation therewith. The collar 82 includes a central bore 94 and a first and second surface 96, 98, whereby the first surface 96 of the slide head 82 opposes and is attached to the second surface 92 of the slide ring 80. The central bore 94 rotatably receives the drive shaft 26 such that the drive shaft 26 is not permitted to rotate relative thereto. The slide head 84 is disposed adjacent to the collar 82 and includes a reaction surface 100, an engagement surface 102, and a recess 104. The reaction surface 100 is disposed adjacent the second surface 92 of the slide ring 80 whereby the reaction surface 100 is spaced from the second surface 92 of the slide ring 80 to define an air stream therebetween, as will be discussed further below. The slide head 84 is non-rotatably supported by a bracket 106, whereby the bracket 106 includes a reaction surface 108, a channel 110, and a flange 112, extending from the channel 110. The slide head 84 is supported generally between the flange 112 and the reaction surface 108, and is permitted to translate therein. The slide head 84 is supported by a spring 114 disposed in the channel 110 such that the spring 114 imparts a bias on the slide head 84 such that the slide head 84 is biased toward, but does not contacts the second surface 92 of the slide ring 80. Spring 114 limits the axial movement of the slide head due to pressure variations. The bracket 106 further supports the slide head 84 through the interaction of an O-ring 116, whereby the O-ring 116 is disposed between the reaction surface 108 and the recess 104 of the slide head 84, as best shown in FIG. 2. In this manner, the slide head 84 is permitted to translate relative to the bracket 106 through the bias imparted thereon by the spring 114. The O-ring 116 serves to maintain a seal between the reaction surface 108 and the slide head 84 as the slide head 84 translates relative to the bracket 106. In this regard, the recess 104 provides a clearance 118 generally between the bracket 106 and the slide head 84 to provide the slide head 84 with the ability to move relative to the bracket 106 while still maintaining contact with the O-ring 116. The bracket 106 is fixedly supported by the partition wall 64 at the central aperture 120 by the shield 86 in an effort to provide the bracket 106 with the requisite strength required to support the seal 40 and further to prevent fluids from entering the seal 40. The shield 86 extends from the flange 112 and includes a flange 122 which serves to block an area generally between the slide head 84 and the slide ring 80. Specifically, as the fluid is caused to flow over the second seal 40, the flange 122 blocks the flow from entering the second seal 40 and directs the flow to an area generally between the slide head 84 and the slide ring 80. In this manner, the fluid enters the seal 40 generally between the slide head 84 and the slide ring 80 in a controlled manner, and may be controlled through the interaction of the slide ring 80, the slide head 84, and collar 82. Specifically, because of the rotation of slide ring 80 relative to slide head 84, an airstream is created flowing into the compressor chamber 34 sealing it against loss of hydrogen coming out of it.

To regulate the flow of fluid through the seal 40, the spring 114 is adjusted to fit the particular application. Because the slide ring 80 is rotating relative to the slide head 84, precise adjustment of the spring 114, such that the slide head 84 is maintained in close proximity to the slide ring 80 is required. Maintaining the slide head 84 in close proximity to the second surface 92 of the slide ring 80 is important as this will restrict fluid flow through the seal 40 and will thereby improve the overall effectiveness of the seal. Adjustment of the spring constant, or type of spring used, will vary depending on the application and desired fluid flow through the seal 40. Specifically, if a small amount of fluid flow is desirable, spring 114 can be utilized so as to get as close to the second surface 92 of the slide ring 80 as possible, while to allow for more fluid to pass through the seal 40, the spring 114 will be relaxed, thereby increasing the distance between the slide head 84 and slide ring 80. In the present case, it is desirable to inhibit most, if not all, of the fluid from passing through the seal 40 to ensure that the compressor chamber 34 is sealed from the neutral chamber 16. However, a slight flow of hydrogen through this seal 40 is properly channeled out of the neutral chamber 16 due to the positive pressure on the back side of seal 42 and the operation of the fan 28 within the neutral chamber 16. Thus, no hydrogen leakage through the seal 40 is allowed to enter the motor chamber 42.

The seal 40, as just described, is defined as a gas seal as opposed to a mechanical friction seal, as there is no friction between the slide head 84 and slide ring 80. It is estimated that as compared to a standard friction-type mechanical seal, the friction work is reduced to less than six percent for the gas sealed seal construction as compared to the standard friction-type seal. Thus, the system of the present invention, while allowing slight flow of hydrogen through the seal 40 greatly reduces the amount of friction work required as compared to a friction-type seal. A hydrogen gas that passes through the seal 40 is properly discharged from the neutral chamber 60 so that it cannot enter the motor chamber 22.

Figure 3:
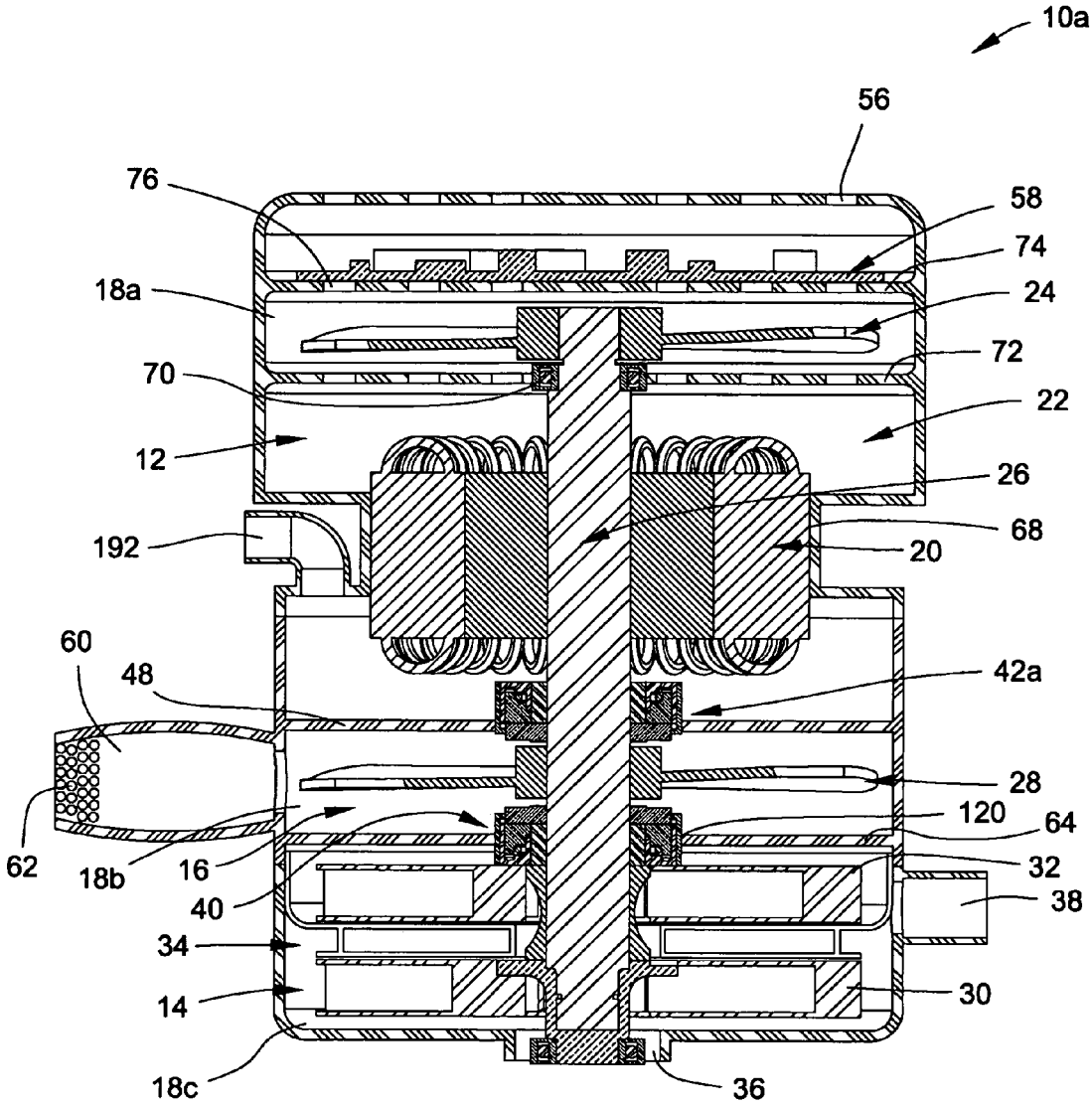
FIG. 3 is a cross-sectional view of a second embodiment of a hydrogen blower in accordance with the principles of the present invention.

With reference to FIG. 3, the construction of the hydrogen blower 10*a* is the same as described above with reference to FIG. 1 with the exception that the seal 42*a* has been changed to a gas-type seal as described above with respect to the seal 40. In addition, an additional air outlet 192 is provided in the motor chamber 22 to exhaust a majority of the air that is blown through the motor chamber 22, while still maintaining a predetermined air pressure on the seal 42*a* to allow a small amount of air leakage through the seal 42*a*, as described above with reference to gas seal 40. With this arrangement, small amounts of air are allowed to leak through seal 42*a* and small amounts of hydrogen are allowed to leak through seal 40. These small amounts of air and hydrogen are mixed in the neutral chamber 16 and discharged through the outlet passage 60 due to the rotation of the fan 28.

The description of the invention is merely exemplary in nature and, thus, variations that do not depart from the gist of the invention are intended to be within the scope of the invention. Such variations are not to be regarded as a departure from the spirit and scone of the invention.

What is claimed is:

1. A hydrogen blower comprising:

a housing;

a drive unit disposed within said housing;

a compressor unit disposed within said housing and driven by said drive unit; and a neutral chamber disposed between said drive unit and said compressor, said drive unit includes a drive shaft extending from said drive unit through said neutral chamber to rotatably drive said compressor, wherein said drive shaft drives a first fan, said first fan operable to drive an air stream in a first direction over said drive unit and into said neutral chamber.

2. The hydrogen blower of claim 1, wherein said drive unit drives a second fan disposed within said neutral chamber, said second fan operable to drive said air stream to an exit passage.

3. The hydrogen blower of claim 2, wherein said exit passage includes a catalyzer to react said fluid mixture disposed within said neutral chamber prior to said fluid mixture being dissipated from said housing.

4. The hydrogen blower of claim 1, wherein said drive unit is sealed from said neutral chamber by a restricted flow passage allowing a predetermined amount of an air flow through said gas seal from said drive unit into said neutral chamber.

5. The hydrogen blower of claim 1, wherein said drive unit is sealed from said neutral chamber by a gas seal to prevent hydrogen flow through said gas seal from said neutral chamber.

6. The hydrogen blower of claim 1, wherein said compressor is sealed from said neutral chamber by a gas seal to inhibit hydrogen flow through said gas seal and into said neutral chamber.

7. The hydrogen blower of claim 1, wherein said drive unit is driven in response to a signal from a control unit, said control unit operable to control said drive unit in response to a load experienced by said compressor.

8. The hydrogen blower of claim 1, wherein said neutral chamber is operable to seal said drive unit from said compressor.

9. The hydrogen blower of claim 1, wherein said compressor includes an outlet passage, said outlet passage operable to supply compressed hydrogen to an external source.

10. A hydrogen blower comprising:

a housing;

a drive unit disposed within said housing;

a compressor unit disposed within said housing and driven by said drive unit; and a neutral chamber disposed between said drive unit and said compressor, wherein said housing includes an ambient air inlet disposed in close proximity to said drive unit, said inlet operable to allow ambient air to enter said housing.

11. A hydrogen blower comprising:

a housing;

a drive unit disposed in a first section of said housing;

a compressor unit disposed within a second section of said housing and driven by said drive unit; and a neutral chamber disposed between said first and second sections of said housing, said neutral chamber operable to seal said first section from said second section, wherein said drive unit includes a drive shaft, said drive shaft operable to drive said compressor and said drive shaft drives a first fan disposed within said first chamber, said first fan operable to drive a stream of ambient air over said drive unit.

12. The hydrogen blower of claim 11, wherein said first section includes an exit passage for said ambient air.

13. The hydrogen blower of claim 11, wherein said compressor includes an outlet passage, said outlet passage operable to supply compressed hydrogen to an external source.

14. The hydrogen blower of claim 11, wherein said drive unit is driven in response to a signal from a control unit, said control unit operable to control said drive unit in response to a load experienced by said compressor.

15. A hydrogen blower comprising:

a housing;

a drive unit disposed in a first section of said housing;

a compressor unit disposed within a second section of said housing and driven by said drive unit; and a neutral chamber disposed between said first and second sections of said housing, said neutral chamber operable to seal said first section from said second section, wherein said first section includes an ambient air inlet disposed in close proximity to said drive unit, said inlet operable to allow ambient air to enter said housing.

16. The hydrogen blower of claim 11, wherein said first section is sealed from said neutral chamber by a gas seal to inhibit an air flow through said gas seal and into said neutral chamber.

17. The hydrogen blower of claim 11, wherein said second section is sealed from said neutral chamber by a gas seal to prevent hydrogen from flowing through said gas seal and into said neutral chamber.

18. A hydrogen blower comprising:

a housing;

a drive unit disposed in a first section of said housing;

a compressor unit disposed within a second section of said housing and driven by said drive unit; and a neutral chamber disposed between said first and second sections of said housing, said neutral chamber operable to seal said first section from said second section, wherein said drive unit drives a fan disposed within said neutral chamber, said fan operable to drive a fluid mixture to an exit passage.

19. The hydrogen blower of claim 18, wherein said exit passage includes a catalyzer to react said fluid mixture disposed within said neutral chamber prior to said fluid mixture being dissipated from said housing.

20. A method of preventing a gas from entering a motor chamber from a hydrogen blower disposed adjacent thereto, the method comprising the steps of:

providing a motor chamber with an ambient air inlet;

driving said ambient air to pressurize said motor chamber; and providing said motor chamber with an outlet to expel said; and providing a neutral chamber between said motor chamber and a compressor chamber.

21. The method of claim 20, further comprising the step of pressurizing said neutral chamber, said pressurization operable to draw a predetermined amount of said air from said motor chamber into said neutral chamber through a restricted flow passageway disposed between said motor housing and said compressor housing.

22. The method of claim 20, further comprising the step of pressuring said neutral chamber, said pressurization operable to drive a fluid mixture from said neutral chamber to an exit passage.

23. The method of claim 20, further comprising the step of providing said motor chamber with a gas seal, said gas seal operable to inhibit fluid flow between said motor chamber and the hydrogen blower.

* * * * *